United States Patent [19]

Finegan, Jr.

[11] 4,042,903

[45] Aug. 16, 1977

[54] POWER CONTROL SLIDE SWITCH

[75] Inventor: John J. Finegan, Jr., Richardson, Tex.

[73] Assignee: Hunt Electronics Company, Dallas, Tex.

[21] Appl. No.: 667,203

[22] Filed: Mar. 15, 1976

[51] Int. Cl.[2] ..... H01C 10/00

[52] U.S. Cl. ..... 338/159; 174/16 HS; 338/198; 338/199

[58] Field of Search ..... 338/51, 159, 172, 174, 338/179, 184, 188, 190, 191, 198, 199, 200; 200/153 P, 156; 174/16 HS

[56] References Cited

U.S. PATENT DOCUMENTS

| | | | |
|---|---|---|---|
| 1,559,427 | 10/1925 | Hemphill | 338/198 X |
| 3,431,530 | 3/1969 | Bang | 338/199 X |
| 3,746,923 | 7/1973 | Spira et al. | 338/159 X |
| 3,798,506 | 3/1974 | English | 174/16 HS X |
| 3,842,328 | 10/1974 | Supel et al. | 338/198 X |

*Primary Examiner*—C. L. Albritton
*Attorney, Agent, or Firm*—Giles C. Clegg, Jr.

[57] ABSTRACT

A power control device utilizing a circular control potentiometer having a rotatable control shaft may be adapted to a slide switch configuration by attaching a pinion gear to the shaft. A slide bar having a rack member for engagement with the pinion gear may then be utilized in place of the knob typically utilized with the shaft. The fins of the heat sink associated with the power control device advantageously act as guide channels for the slide bar. A cover member having a slot adapted to accept the slide bar handle fits over the slide bar and heat sink, acting as a retainer for the slide bar and providing a chimney effect for the heat sink.

4 Claims, 4 Drawing Figures

POWER CONTROL SLIDE SWITCH

BACKGROUND OF THE INVENTION

This invention relates to power control devices, and, more particularly, to an improved handle assembly therefor.

In conventional power control devices, such as for example, light dimming devices for incandescent lighting systems, power control may be achieved by controlling the conduction time of a switching device, commonly referred to a phase control of power. Power supplied to a lead is controlled through the use of a potentiometer which is a part of a power control circuit connected between the power source and the lighting system. Typical prior art systems have utilized a circular potentiometer having a shaft extending outwardly therefrom to which is attached a knob. By rotating the knob, the resistance of the potentiometer is varied to control the amount of power applied to the lighting system. Typically, the amount of power applied to the lighting system, and correspondingly the amount of light given off thereby, increases as the control knob is turned in a clockwise direction and decreases as the control knob is turned in a counterclockwise direction, a commonly used type of potentiometer having an OFF detented position in which a switch is open when the knob is turned fully in the counterclockwise direction.

While the aforedescribed arrangement where the power control is effected by turning a knob may be suitable for most applications, certain applications and personal subjective preferences may call for an arrangement where the control is achieved in a linear manner, that is by sliding a control handle back and forth. One way of achieving this is to provide a linear potentiometer in place of the aforedescribed circular potentiometer. However, this approach has several disadvantages. For example, a linear potentiometer with a full OFF detented position in which a switch is open is not readily available commercially at a reasonable price. Further, the use of a linear potentiometer in place of a circular potentiometer would require completely different tooling and packaging. This latter factor also would cause a cost increase if both types of controls are to be offered for sale.

It is therefore an object of the present invention to provide a power control device which may be operated in a linear manner.

It is a further object of this invention to provide such a device wherein a readily available conventional circularly operated device may be easily converted to linear operation.

SUMMARY OF THE INVENTION

The foregoing and additional objects are attained by providing a power control device utilizing a circular potentiometer. The power control device is mounted on a finned or channeled heat sink member. The control shaft of the circular potentiometer is fitted with a pinion gear. A slide bar having a rack for engagement with the pinion gear is adapted to move in the channels of the heat sink. A cover member adapted to retain the slide bar in the channels has a slot for accepting the slide bar handle and fits over the slide bar.

DESCRIPTION OF THE DRAWING

The foregoing will be more readily understood upon reading the following description in conjunction with the drawing in which.

DESCRIPTION OF THE PREFERRED EMBODIMENT

Figure 1:
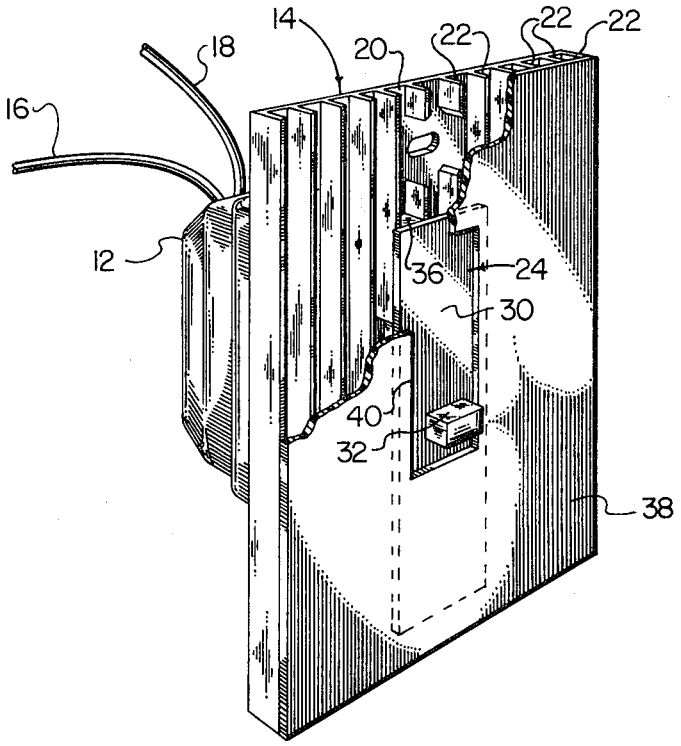
FIG. 1 is a perspective view, partially broken away, of a power control device embodying improvements according to this invention.
Figure 2:
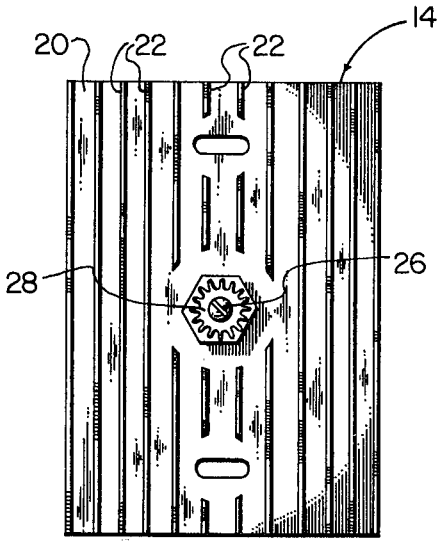
FIG. 2 is a front elevation view of the apparatus shown in FIG. 1 with the cover and slide bar removed therefrom.
Figure 3:
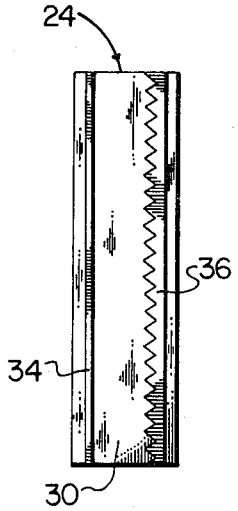
FIG. 3 is an elevation view of the slide bar as viewed from the heat sink of the power control device.
Figure 4:
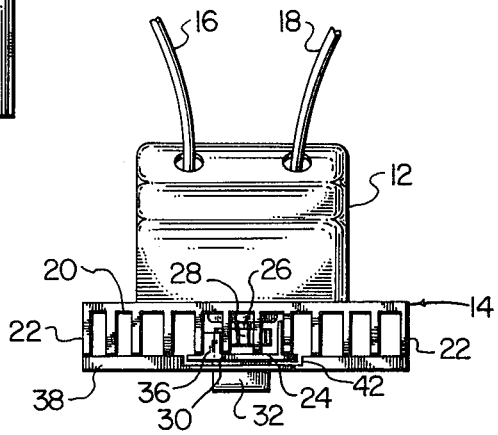
FIG. 4 is a top plan view of the apparatus shown in FIG. 1.

Referring now to the drawing, a complete power control device assembly includes a housing 12 mounted on a heat sink member 14. Inside housing 12 is a control circuit including a circular potentiometer having an integral switch. The power control device is adapted to be connected between a source of power and the load to be controlled by means of a pair of wires 16 and 18 extending through openings in housing 12. Heat sink 14 comprises a plate 20 and a plurality of longitudinal fins or ribs 22 extending perpendicularly outward from plate 20. The fins 22 form channels therebetween. Heat sink 14 may be machined or extruded from aluminum or other metal having good heat conductivity characteristics. Also included in the power control device assembly is a slide bar 24 used for controlling the angular position of the circular potentiometer within housing 12, in a manner to be described hereinafter.

Extending out from housing 12 through plate 20 is potentiometer shaft 26. In the prior art mode of operation, a knob, not shown, is adapted to be fitted over shaft 26. However, in the improvement contemplated by this invention, the knob may be removed and a gear 28 may be fitted over shaft 26. Gear 28 should be fitted on shaft 26 so that there is no relative motion therebetween. This may be accomplished in any of several different simple ways such as for example by cementing gear 28 to shaft 26, or by means of a set screw through gear 28, or by press fitting gear 28 on shaft 26. Slide bar 24 comprises a bar 30, a handle 32, a rail 34 extending longitudinally and perpendicularly from bar 30 on the opposite side of bar 30 from handle 32, and a rack 36 parallel to rail 34. The teeth of rack 36 are adapted to engage the teeth of gear 28. Rail 34 and rack 36 are spaced so that they ride within fins 22 of heat sink 14, the fins serving the additional function of acting as guides for slide bar 24. In operation, the slide bar 24 is moved parallel to the fins 22. This linear motion of slide bar 24 is converted by means of the rack and pinion operation of rack 36 and gear 28 into a circular motion of shaft 26, resulting in full operation of the control potentiometer within housing 28, including the use of the full off detent position of the potentiometer switch.

To retain rack 36 in engagement with gear 28, and for other purposes to be described hereinafter, a cover member 38 is provided. Cover 38 is essentially planar and has a slot 40 through which handle 32 extends. Slot 40 is sufficiently wide to accept handle 32 therethrough and is sufficiently long to accommodate the full length of travel of handle 32 when slide bar 24 is operated to its extreme positions. Cover 38 is also formed with a channel 42 dimensioned so that bar 30 of slide bar 24 fits therein. Cover 38 may be held in place by any of several different methods, not shown. For example, cover 38 may be snapped onto fins 22 either by means of spring clips or extensions of the cover itself. Alternatively, cover 38 may be attached to plate 20 of heat sink 14 by means of screws or bolts. This attachment of cover 38 to heat sink 14 provides for the retention of slide bar 24. In addition, cover 38 allows for greater cooling effects of heat sink 14 by providing a chimney effect in the channels between the fins 22. Additionally, the exterior face of cover 38 may be provided with decorative features, such as different colors or designs, to provide an esthetically pleasing appearance.

It is apparent from the foregoing description that the synergestic combination of elements provides certain unexpected advantages. With a single basic package, comprising the power control device within housing 12 and the finned heat sink member 14, two types of control motion may be selected, i.e. circular or linear. If the circular mode of control motion is chosen, a conventional knob may be fitted over the control potentiometer shaft. When the linear motion control is selected, a gear is fitted over the control potentiometer shaft and a slide bar having a rack is meshed with the gear teeth. In this latter arrangement, the fins of the heat sink serve a dual function. Firstly they afford a radiation surface for heat dissapation and secondly they serve as guides for the slide bar. Accordingly, there has been described an improved control arrangement. It is understood that the above-described arrangement is merely illustrative of the application of the principles of this invention. Numerous other arrangements may be devised by those skilled in the art without departing from the spirit and scope of this invention as defined by the appended claims.

What is claimed is:

1. In combination with a power control device including parallel finned heat sink means and a control shaft extending through said heat sink means, said power control device including means responsive to the angular position of said control shaft for effecting a power transfer function:

gear means mounted on said control shaft;

a slidable control handle member having teeth adapted to engage said gear means and product rotation of said control shaft responsive to linear movement of said control handle member; and means supporting said handle member on said control device for linear movement with said teeth in engagement with said gear.

2. The combination of claim 1 wherein said handle member comprises:

a bar having a handle extending outwardly from one side thereof; and a plurality of parallel rails extending out from said bar on the side opposite said handle, one of said rails having teeth for engaging said gear means and said rails being dimensioned to fit between respective pairs of the heat sink fins.

3. The combination of claim 2 further comprising a cover adapted to fit over said heat sink means and said handle member, said cover having a slot therein dimensioned so that said handle extends therethrough and moves therein over its entire length of travel.

4. A slide switch assembly for a power control device which includes parallel finned heat sink means and a control shaft extending through said heat sink means for effecting a power control function dependent upon the angular position of said control shaft, said assembly comprising:

gear means mounted on said control shaft;

a bar having a handle extending outwardly from one side thereof;

a pair of parallel rails extending out from said bar on the side opposite said handle and dimensioned to fit between respective pairs of said heat sink fins, one of said rails having teeth along one side for engaging said gear means, the separation between opposed surfaces of said rails being dimensioned to maintain the teeth on said rail in engagement with said gear with the opposed surface of the other rail in sliding engagement with one side of one of said fins;

a cover member adapted to fit over said heat sink means and said bar, said cover having a slot therein dimensioned so that said handle extends therethrough and moves therein over its entire length of travel, said cover member further having a channel adjacent said fins running parallel thereto and having a width substantially equal to the width of said bar and adapted to retain said bar therein when said teeth engage said gear means;

the number of teeth on said one rail and the number of teeth on said gear being such that the control shaft is rotated between opposite desired positions as the handle traverses a distance not greater than the length of the slot.

* * * * *